US006857205B1

(12) United States Patent
Fusco et al.

(10) Patent No.: US 6,857,205 B1
(45) Date of Patent: Feb. 22, 2005

(54) ARTICLE OF FOOTWEAR HAVING A SOLE STRUCTURE WITH A SPLIT PLATE

(75) Inventors: Ciro Fusco, Portland, OR (US); Sean McDowell, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 79 days.

(21) Appl. No.: 10/143,427

(22) Filed: May 9, 2002

(51) Int. Cl.[7] ..... A43B 5/00; A43B 23/00

(52) U.S. Cl. ..... 36/114; 36/31; 36/102; 36/107

(58) Field of Search ..... 36/114, 30 R, 36/31, 129, 59 R, 102, 103, 107

(56) References Cited

U.S. PATENT DOCUMENTS

| | | | | | |
|---|---|---|---|---|---|
| 730,366 | A | | 6/1903 | Gunthorp | |
| 1,545,746 | A | * | 7/1925 | De Groot | 36/59 R |
| 1,611,235 | A | * | 12/1926 | Richardson | 36/59 R |
| 1,684,676 | A | * | 9/1928 | Lorenzi et al. | 36/32 R |
| 2,216,645 | A | * | 10/1940 | Mestrandree | 36/59 R |
| 2,258,734 | A | * | 10/1941 | Brady | 36/59 R |
| 3,237,323 | A | * | 3/1966 | MacNeill | 36/59 R |
| 4,162,583 | A | | 7/1979 | Darrin | |
| 4,454,662 | A | | 6/1984 | Stubblefield | |
| 4,507,879 | A | | 4/1985 | Dassler | |
| 4,546,559 | A | * | 10/1985 | Dassler | 36/129 |
| 4,574,498 | A | * | 3/1986 | Norton et al. | 36/114 |
| 4,922,631 | A | | 5/1990 | Anderie | |
| 5,052,130 | A | | 10/1991 | Barry et al. | |
| 5,245,766 | A | | 9/1993 | Warren | |
| 5,319,866 | A | | 6/1994 | Foley et al. | |
| 5,384,973 | A | | 1/1995 | Lyden | |
| 5,452,526 | A | | 9/1995 | Collins | |
| 5,473,827 | A | * | 12/1995 | Barre et al. | 36/134 |
| 5,647,145 | A | | 7/1997 | Russell et al. | |
| 5,832,634 | A | | 11/1998 | Wong | |
| 5,843,268 | A | * | 12/1998 | Lyden et al. | 156/324.4 |
| 5,979,083 | A | * | 11/1999 | Robinson et al. | 36/127 |
| 6,009,641 | A | | 1/2000 | Ryan | |

* cited by examiner

*Primary Examiner*—M. D. Patterson
(74) *Attorney, Agent, or Firm*—Banner & Witcoff, Ltd.

(57) ABSTRACT

The invention is an article of footwear that includes a sole structure having a plate assembly that includes a separator plate and a split plate. The split plate is located in a midfoot portion of the sole structure and includes a lateral portion and a medial portion separated by a split. The separator plate is located within the split and is attached to the split plate. When compressed against a surface, the longitudinal portion and the medial portion separate further, thereby increasing the width of the split and dissipating energy.

50 Claims, 3 Drawing Sheets

ARTICLE OF FOOTWEAR HAVING A SOLE STRUCTURE WITH A SPLIT PLATE

BACKGROUND OF THE INVENTION

1. Field of the Invention

The present invention relates to footwear. The invention concerns, more particularly, an article of athletic footwear having a sole structure that includes an energy absorbing split plate.

2. Description of Background Art

The long jump competition, a track and field sporting event, involves three distinct phases: sprinting, launching, and soaring. Initially, an athlete sprints toward a foul line that is positioned before a landing pit. Before the competitor's feet cross the foul line, the competitor launches or jumps upward, thereby becoming airborne. Finally, the competitor soars through the air and over the landing pit in an attempt to have the greatest soaring distance, which is measured from the foul line to the competitor's first point of contact with the landing pit.

In comparison with other track and field sporting events, the long jump competition induces the greatest forces in the foot, particularly during the launch phase. As the athlete sprints toward the foul line, forces experienced by the foot are substantially similar to forces experienced during other track and field events that involve sprinting. Immediately before the foul line, and while sprinting, the athlete places one of the feet upon the ground and presses upward with the leg to provide a forceful launch. During the launch, therefore, the foot not only experiences sprinting forces, but also experiences forces associated with the upward press. The combination of these forces has the potential to be greater than the forces experienced by the foot during any other track and field sporting event.

Conventional articles of footwear intended to be utilized during the long jump competition include an upper that receives the foot and a sole structure that is attached to the upper. The sole structure typically includes a midsole, an outsole, and a traction plate. The midsole is positioned adjacent to the foot and may be manufactured from polyurethane or ethylvinylacetate foam. The outsole is attached to the lower surface of the midsole and may be formed from a durable, wear-resistant material, such as rubber. The traction plate, a semi-rigid element attached to the outsole in the forefoot region of the footwear, includes both texturing and removable metal spikes to enhance traction.

The primary purpose of the midsole is to attenuate shock and absorb energy associated with both the sprinting and launching phases of the long jump competition. That is, the compressive properties of the midsole act to dissipate forces experienced by the foot during the long jump competition. In designing footwear midsoles, a balance is achieved between reducing forces and stability. In general, an increase in midsole thickness imparts both an increase in force reduction and a decrease in stability. A relatively thick midsole, therefore, has greater force reduction properties and lesser stability than a relatively thin midsole.

In comparison with midsole structures of other articles of footwear, particularly footwear designed for long distance running, the midsole of an article of long jump footwear is relatively thin. Although the forces experienced by the foot during the long jump competition, particularly during the launch phase, are significantly greater than the forces experienced during long distance running, the midsole has reduced thickness to retain stability and decrease weight. Long jump footwear, therefore, does not provide an optimal degree of shock attenuation and energy absorption, and a significant portion of the forces associated with sprinting and launch are dissipated internally by the bone of the foot. The internal dissipation of forces not only results in excess stress upon the foot, but may also be detrimental to performance. Conventional midsole designs for long jump footwear do, however, provide stability, thereby imparting a significant degree of control during the sprinting and launching phases of the long jump competition. Accordingly, the art requires an improved article of long jump footwear that retains a high level of stability and dissipates a greater portion of the forces associated with the sprinting and launch phases of the long jump competition, thereby decreasing the overall stress in the foot and increasing the athlete's level of performance.

BRIEF SUMMARY OF THE INVENTION

The present invention is an article of footwear having an upper for receiving a foot of a wearer and a sole structure attached to the upper. The sole structure includes a split plate positioned in at least a midfoot portion of the footwear. The split plate has a lateral portion and a medial portion that are separated by a split formed in the split plate. Accordingly, the split has a width that is measured from the lateral portion to the medial portion across the split, the width increasing in response to a compression of the sole structure between the foot and a surface.

The sole structure also includes a separator plate that is located in the split and between the lateral portion and the medial portion. The separator plate is attached to the split plate and may be formed of a material that has a lesser modulus of elasticity than the material forming the split plate. When the sole structure is compressed, the lateral portion and the medial portion separate, thereby increasing the distance across the split. The more compliant material that forms the separator plate stretches to accommodate the separation. This configuration provides an article of footwear that dissipates a portion of the forces that are generated during the sprinting and launch phases of the long jump competition, thereby decreasing the forces that are dissipated internally by the structure of the foot.

The split plate may also include a plurality of other features, including longitudinal supports, traction elements, and spike receptacles. The longitudinal supports are areas of increased thickness that extend substantially parallel to the split. The function of the longitudinal supports is to facilitate side-to-side motion of the lateral portion and medial portion, but inhibit significant longitudinal movement. The traction elements are raised areas on the split plate that engage the ground and resist movement of the footwear when in contact with the ground. The spike receptacles removably receive metal spikes that provide a significant degree of traction on compliant surfaces, such as a conventional track.

The advantages and features of novelty that characterize the present invention are pointed out with particularity in the appended claims. To gain an improved understanding of the advantages and features of novelty that characterize the present invention, however, reference should be made to the descriptive matter and accompanying drawings which describe and illustrate various embodiments of the invention.

DETAILED DESCRIPTION OF THE INVENTION

The figures and following discussion disclose an article of footwear 100 in accordance with the present invention. Footwear 100 includes novel features that dissipate forces, thereby decreasing the overall stress experienced by a foot when footwear 100 makes contact with the ground. These features are particularly suited to attenuating shock and absorbing energy associated with the launch phase of the long jump competition, a track and field sporting event. Accordingly, footwear 100 is discussed below and depicted in the accompanying figures as an article of footwear suitable for use during the long jump competition. These features of footwear 100 may, however, be applied to a wide range of footwear styles that include both athletic and non-athletic footwear. Accordingly, the concepts disclosed in the following discussion with respect to footwear 100 are not intended to be limited to footwear designed solely for the long jump competition, and may be applied to footwear designed for a wide range of activities.

Figure 1:
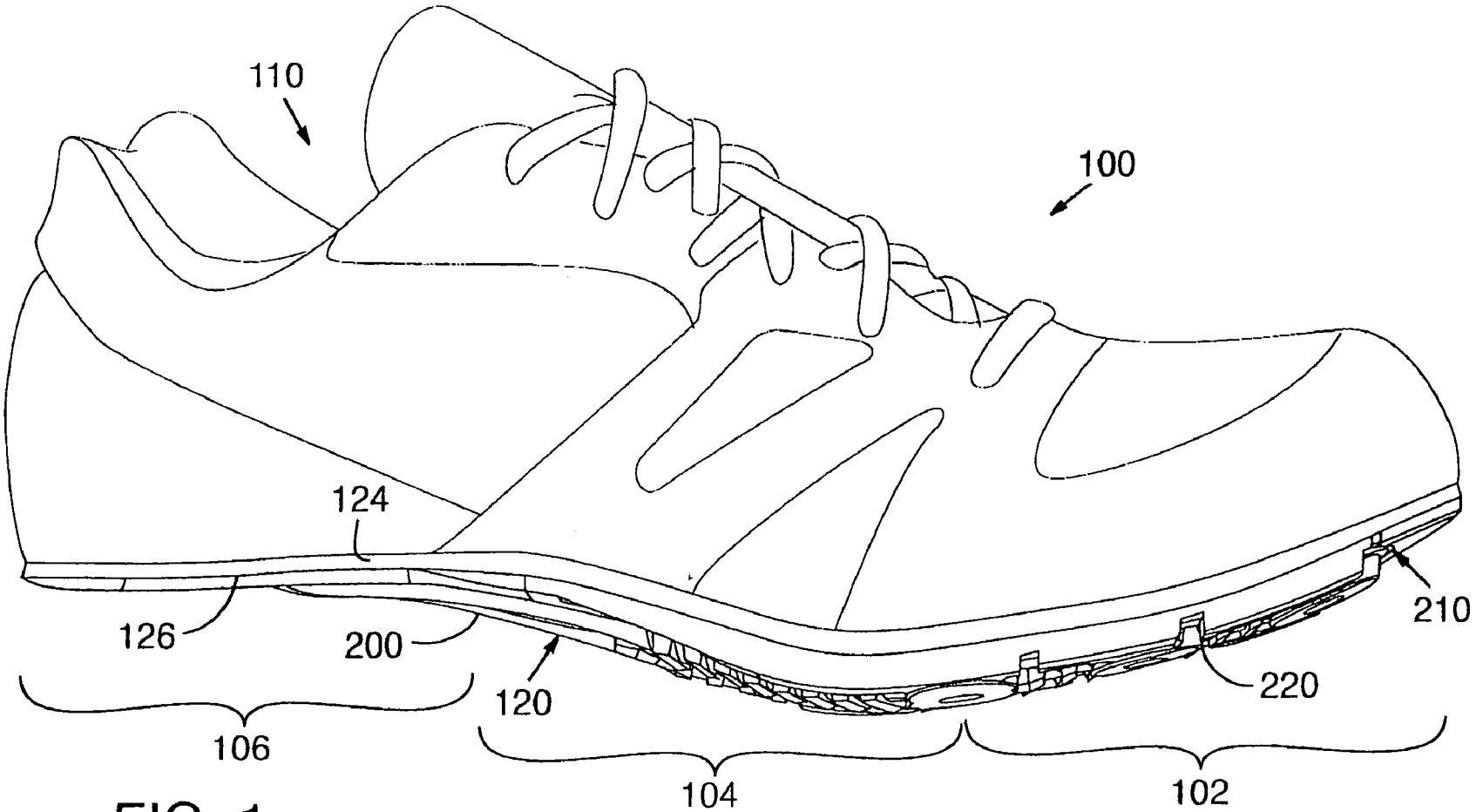
FIG. 1 is a medial elevational view of an article of footwear that includes a plate assembly in accordance with the present invention.
Figure 2:
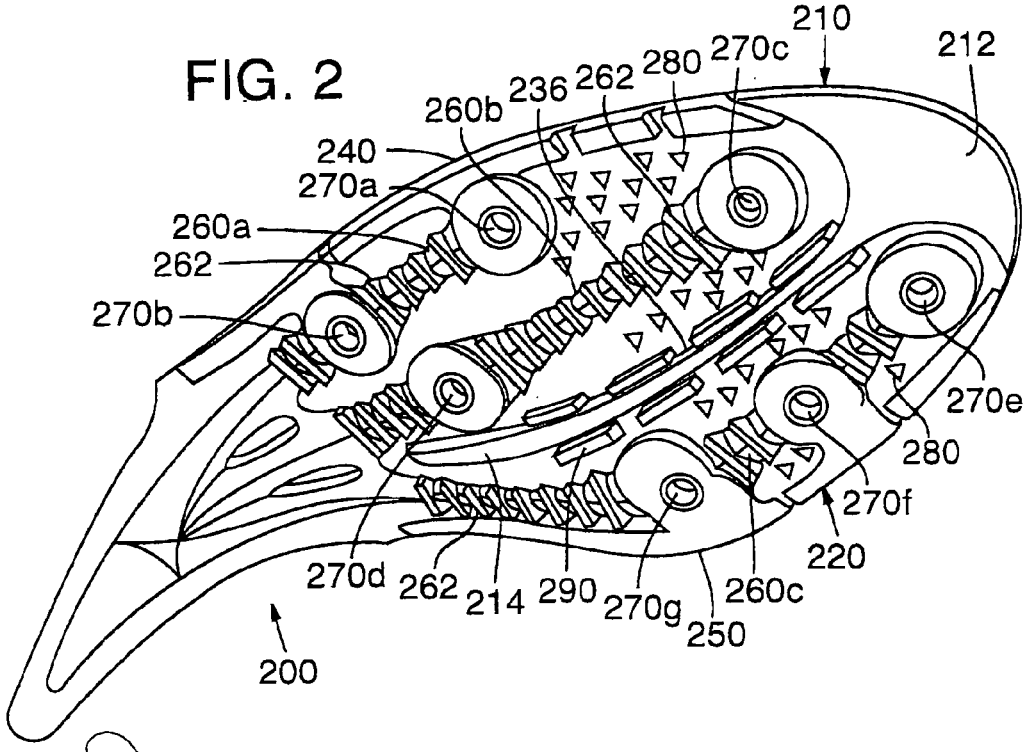
FIG. 2 is a first perspective view that depicts the bottom and lateral side of the plate assembly.
Figure 3:
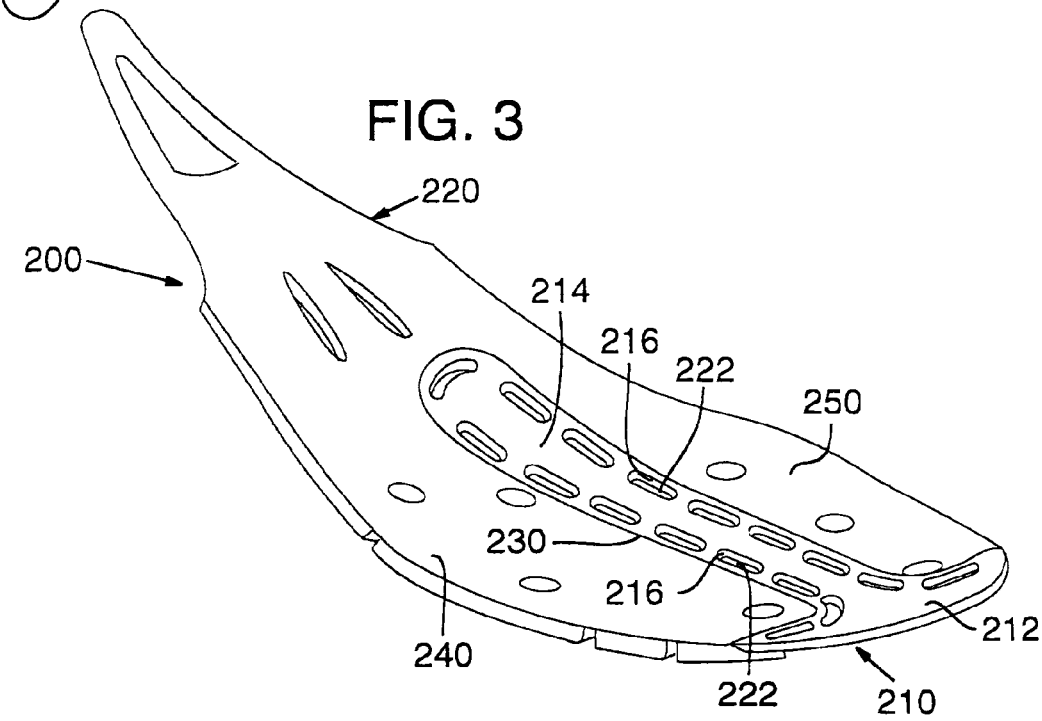
FIG. 3 is a second perspective view that depicts the top and lateral side of the plate assembly.
Figure 4:
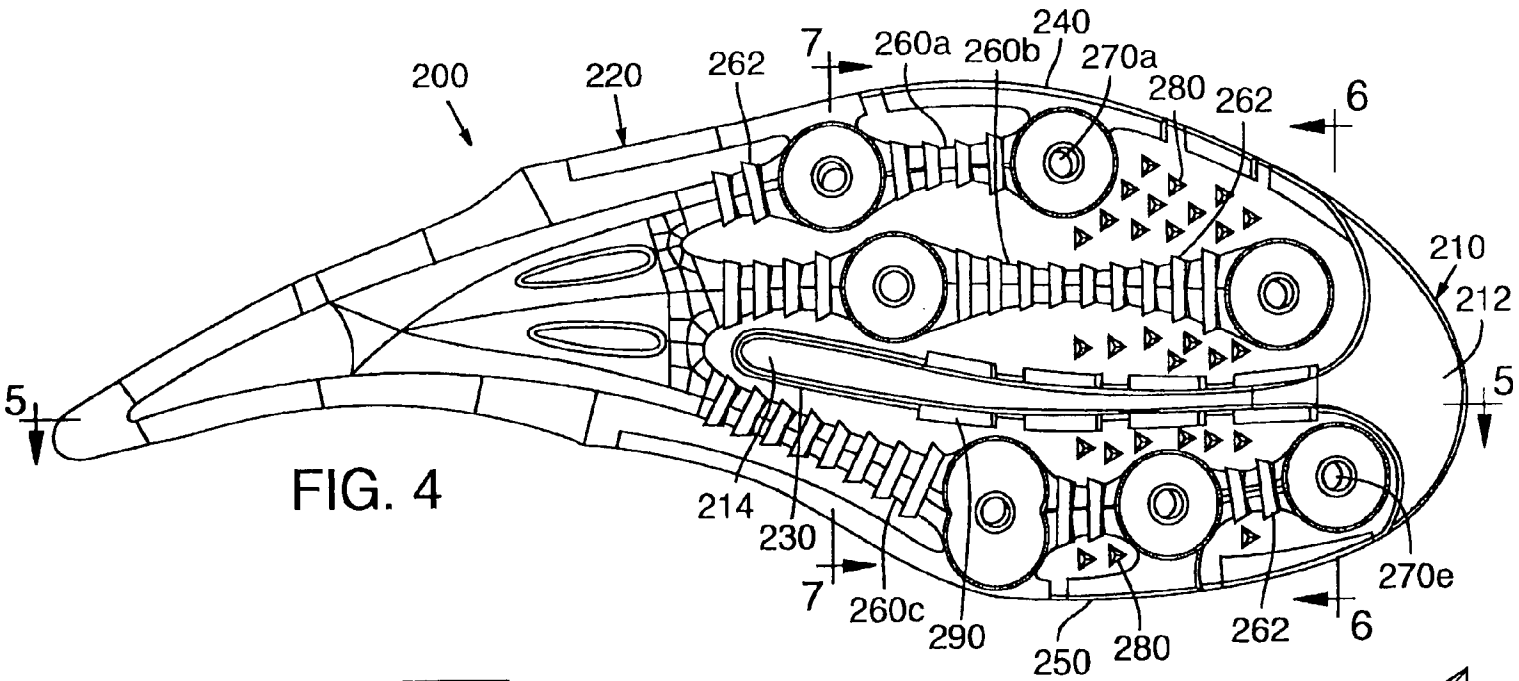
FIG. 4 is a bottom plan view of the plate assembly.
Figure 5:
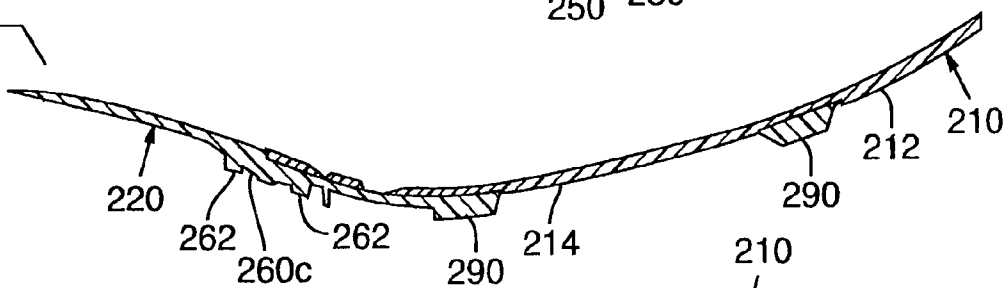
FIG. 5 is a cross-section of the plate assembly, as defined by line 5—5 in FIG. 4, depicting only portions in section.
Figure 6:
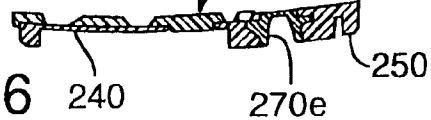
FIG. 6 is a cross-section of the plate assembly, as defined by line 6—6 in FIG. 4, depicting only portions in section.
Figure 7:
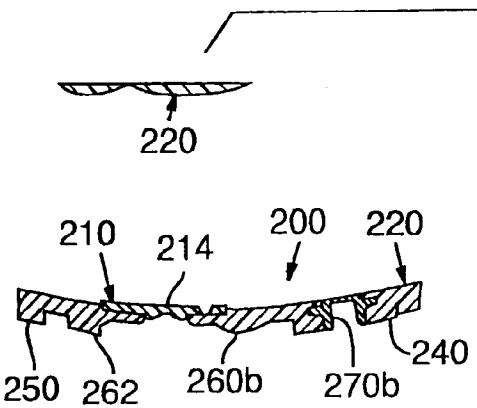
FIG. 7 is a cross-section of the plate assembly, as defined by line 7—7 in FIG. 4, depicting only portions in section.

Footwear 100, depicted in FIG. 1, may be divided into the following three general regions: a forefoot region 102, which generally corresponds with the toes of the foot; a midfoot region 104, which generally corresponds with the arch, instep, and other intermediate portions of the foot; and a heel region 106, which generally corresponds with the heel portion of the foot. Regions 102, 104, and 106 are not intended to be precisely-demarcated areas. Rather, regions 102, 104, and 106 are generally-defined areas of footwear 100 that will aid in understanding the following discussion.

The two primary elements of footwear 100 are an upper 110 and a sole structure 120. Upper 110 is structured to comfortably receive a foot and may include a traditional lacing system that secures footwear 100 to the foot. The materials selected for upper 110 may include a plurality of conventional materials that are, for example, lightweight, waterproof, or breathable. The specific materials selected for upper 110, however, will depend upon the particular activity for which footwear 100 is designed and may include conventional materials for track and field footwear.

Sole structure 120 is attached to upper 110 and includes an insole (not depicted), a midsole 124, an outsole 126, and a plate assembly 200. The insole is located within upper 110 and adjacent to the sole of the foot, thereby enhancing the comfort of footwear 100. Midsole 124 is attached directly to upper 110 and may be formed from conventional midsole materials, including a resilient polyurethane and ethylvinylacetate foam. The primary function of midsole 124 is to attenuate shock and absorb energy during the sprinting and launching phases of the long jump competition, thereby decreasing the overall forces experienced by the foot. In order to decrease the overall weight of footwear 100 and enhance stability, midsole 124 may have lesser thickness than midsoles utilized in footwear that is designed for long distance running. Outsole 126 is attached to the lower surface of midsole 124 and provides a durable, wear-resistant surface that engages the ground in at least heel region 106. Exposed portions of outsole 126 may include texturing to enhance traction. Plate assembly 200 is secured to outsole 126 and forms the bottom portion of sole structure 120. Alternatively, plate assembly 200 may protrude through a portion of outsole 126 and attach to midsole 124.

Plate assembly 200, depicted individually in FIGS. 2-7, provides an energy dissipating structure. During the sprinting and launch phases of the long jump competition, significant forces are generated by the downward pressure of the foot against the ground. These forces act to propel the athlete forward and launch the athlete upward. To the detriment of the athlete, however, a considerable portion of the forces are dissipated internally by the structure of the foot. Plate assembly 200 decreases the forces that are dissipated internally by the structure of the foot by attenuating shock and absorbing energy. The unique design of plate assembly 200 does not, however, significantly decrease the forces that assist in propelling the athlete or launching ail the athlete, thereby providing the athlete with maximum speed during the sprinting phase and upward momentum during the launch phase. In addition, plate assembly 200 may be configured to provide a relatively great degree of traction. The manner in which plate assembly 200 performs these functions will be discussed in greater detail below.

The primary elements of plate assembly 200 are a separator plate 210 and a split plate 220. Separator plate 210 is generally structured to have a T-shaped configuration and includes a fore portion 212 that is integrally-formed with a longitudinal portion 214. Fore portion 212 is located within forefoot region 102 and corresponds with the horizontal segment of the T-shaped configuration. Longitudinal portion 214, which corresponds with the vertical segment of the T-shaped configuration, extends from fore portion 212 into midfoot region 104. That is, longitudinal portion 214 extends longitudinally along at least a portion of plate assembly 200 and toward heel region 106.

Split plate 220 abuts separator plate 210 and includes a split 230 that receives longitudinal portion 214. Split plate 220 is positioned in at least midfoot region 104, but may also extend into forefoot region 102 and heel region 106. Split 230 extends longitudinally toward heel region 106 and divides split plate 220 into a lateral portion 240 and a medial portion 250. Separator plate 210 and split plate 220 may be connected to each other through a variety of attachment methods, including integral fasteners, adhesives, or heat bonding. As depicted in the figures, split plate 220 includes a plurality of projections 222 that are received by corresponding apertures 216 in separator plate 210.

The materials forming separator plate 210 and split plate 220 will generally be related with regard to their respective moduli of elasticity. For reasons that will become apparent in the discussion below, separator plate 210 generally has a lesser modulus of elasticity than split plate 220. Accordingly, the material forming separator plate 210 has greater flex and stretch properties than the material forming split plate 220. Although a plurality of material in combinations provide this relationship, suitable materials for separator plate 210 and split plate 220 are nylon 6 and nylon 12, respectively. In addition, separator plate 210 and split plate 220 may be formed of low and high modulus versions of polyether block amide, such as PEBAX, which is manufactured by the Atofina Company of Paris, France. Polyether block amide provides a variety of characteristics that benefit the present invention, including high impact resistance at low temperatures, few property variations in the temperature range of negative 40 degrees Celsius to positive 80 degrees Celsius, resistance to degradation by a variety of chemicals, and low hysteresis during alternative flexure.

The structural attributes of plate assembly 200 are based upon the motion of footwear 100 during the sprinting and launch phases of the long jump. Plate assembly 200 operates in conjunction with the motion of footwear 100 to dissipate a portion of the forces that are dissipated internally by the structure of the foot. The motion of footwear 100 during the sprinting phase of the long jump competition proceeds as follows: Initially, footwear 100 contacts the ground in the area of midfoot region 104 and forefoot region 102. Footwear 100 then rolls forward such that the area corresponding with forefoot region 102 makes contact with the ground. Finally, all of footwear 100 leaves the ground and another cycle begins. The motion of footwear 100 during the launch phase is substantially similar, except that the athlete presses upward to facilitate a launch during the portion of the stride where both midfoot region 104 and forefoot region 102 are in contact with the ground.

Plate assembly 200, particularly the portion of plate assembly 200 that includes split 230, is located in midfoot region 104 and extends into forefoot region 102. Separator plate 210 and split plate 220 are, therefore, compressed between the ground and the foot during sprinting and prior to launch. With respect to the launch phase in particular, split 230 is positioned to contact the ground during the portion of the launch phase where peak compressive forces are generated. In response to the compressive forces, lateral portion 240 and medial portion 250 tend to separate, thereby increasing the width across split 230. In addition, longitudinal portion 214 stretches transversely in response to the increasing distance between lateral portion 240 and medial portion 250, thereby accommodating the outward movement of lateral portion 240 and medial portion 250. A first degree of force is required to separate lateral portion 240 and medial portion 250 and a second degree of force is required to transversely stretch longitudinal portion 214. The combination of the first and second forces translates into the total force that is dissipated by plate structure 200, thereby decreasing a portion of the forces that are dissipated by the foot.

A similar result could be achieved by increasing the thickness of midsole 124 in midfoot region 104 and forefoot region 102. Although the foam materials that comprise midsole 124 would be effective to dissipate forces, the foam materials would also absorb a portion of the energy that provides upward momentum to the athlete during the launch phase. The structure of plate assembly 200, however, efficiently transfers forces to the ground and provides the athlete with a greater percentage of force that may be utilized for the launch.

Split plate 200 includes three longitudinal supports 260, which are reinforced or thickened areas of split plate 200 that extend substantially parallel to split 230. Longitudinal supports 260*a* and 260*b* extend along the length of lateral portion 240. In addition, longitudinal support 260*c* extends along the length of medial portion 250. Longitudinal supports 260 may be formed from the same material as the remainder of split plate 200 and provide additional material that restrains longitudinal movement of both lateral portion 240 and medial portion 250. That is, longitudinal supports 260 inhibit split plate 200 from significantly compressing in the direction from forefoot region 102 to heel region 106. As discussed above, benefits are gained by facilitating a transverse movement of lateral portion 240 and medial portion 250. The design of longitudinal supports 260 does not significantly hinder this outward movement of lateral portion 240 and medial portion 250, but does significantly hinder longitudinal compression.

Longitudinal supports 260 include a plurality of ribs 262 that provide a flat ground contacting surface for footwear 100 and provide traction. Whereas longitudinal supports 260 may have a rounded configuration, ribs 262 have a flat lower surface. In general, ribs 262*a* are positioned on longitudinal support 260*a* and are located on the same plane as ribs 262*b* and 262*c*, which are located on longitudinal supports 260*b* and 260*c*, respectively. Accordingly, ribs 262 provide a flat base that extends across the width of plate assembly 200. The flat base is supplemented by a plurality of projections 290 that extend downward from lateral portion 240 and medial portion 250 in the area adjacent to split 230.

Split plate 220 includes a plurality of spike recesses 270 and traction elements 280. Spike recesses 270 form raised areas on split plate 270 and removably receive traditional metal spikes. Spike recesses 270 are distributed throughout midfoot region 104 and forefoot region 102. More particularly, spike recesses 270*a* and 270*b* are located on lateral portion 240 and positioned along longitudinal support 260*a*. Spike recesses 270*c* and 270*d* are also located on lateral portion 240, but are positioned along longitudinal support 260*b*. Spike recesses 270*e*, 270*f*, and 270*g* are located on medial portion 250 and along longitudinal support 260*c*. Traction elements 280 are distributed throughout the surface of split plate 220 and are depicted as having a pyramidal configuration. Traction elements 280 may have a variety of other configurations within the scope of the present invention. The plurality of ribs 262 provide additional traction to footwear 100.

Based upon the discussion above, plate assembly 200 provides the athlete with three principal benefits. First, plate assembly 200 supplements midsole 124 by providing additional energy dissipation, thereby decreasing the total forces dissipated by the bone structure of the foot. More particularly, lateral portion 240 and medial portion 250 of split plate 220 separate in the presence of compressive forces to attenuate shock and absorb energy associated with the sprinting and launch phase of the long jump. Second, plate assembly 200 does not significantly dissipate the forces responsible for providing the athlete with upward momentum during the launch phase of the long jump competition. Third, plate assembly 200 provides footwear 100 with traction, thereby limiting the degree to which footwear 100 moves relative to the ground when in contact with the ground. These benefits are not present in prior art footwear and therefore mark an improvement over prior footwear designs.

The specific dimensions and materials that are utilized to form plate assembly 200 may vary depending upon the foot size of the athlete, the weight of the athlete, or the composition of the sprinting or launching surface, for example. One skilled in the relevant art will have access to data correlating average weights of athletes and foot size. Footwear 100 may then be mass produced to conform to the average athlete. In addition, footwear 100 may be individually produced for the specific needs of an individual.

The concepts disclosed above with respect to footwear 100 are not intended to be limited to footwear designed solely for the long jump competition, and may be applied to footwear that is designed for a wide range of activities. Accordingly, many of the specific features of footwear 100 may be altered to accommodate the various styles of footwear. For example, split 230 is depicted as being located approximately one-third of the distance from the medial side of footwear 100 to the lateral side of footwear 100. Split 230 could be repositioned centrally or on the lateral side. In addition, two or more splits 230 may be formed so as to divide the energy absorbing properties of split plate 220 among various areas. Split 230 may also extend laterally, rather than longitudinally or may have a diagonal direction. In addition, spike receptacles 270 may be removed in footwear designed for activities other than track and field. The positioning and types of traction elements may also be varied to accommodate various other athletic activities, such as soccer, golf, tennis, or football.

The present invention is disclosed above and in the accompanying drawings with reference to a variety of embodiments. The purpose served by disclosure of the embodiments, however, is to provide an example of the various aspects embodied in the invention, not to limit the scope of the invention. One skilled in the art will recognize that numerous variations and modifications may be made to the embodiments without departing from the scope of the present invention, as defined by the appended claims.

That which is claimed is:

1. An article of footwear comprising:

an upper for receiving a foot of a wearer; and a sole structure attached to said upper, said sole structure including a split plate with a forefoot area that extends through substantially all of a forefoot portion of said footwear, said split plate having a first portion and a second portion that are formed as a one-piece element and separated by a split formed in said split plate, said split extending from a front of the split plate to a midfoot portion of said footwear in a generally longitudinal direction such that said first portion is located on a lateral side of said sole structure and said second portion is located on a medial side of said sole structure, said first portion and said second portion being unconnected in the forefoot portion of the footwear.

2. The article of footwear of claim 1, wherein said split is located closer to said medial side than said lateral side.

3. The article of footwear of claim 1, wherein said sole structure includes a separator plate, said separator plate being located within said split.

4. The article of footwear of claim 3, wherein said separator plate is attached to said split plate.

5. The article of footwear of claim 3, wherein said split plate is formed of a first material and said separator plate is formed of a second material, said first material having a first modulus of elasticity and said second material having a second modulus of elasticity, said first modulus of elasticity being greater than said second modulus of elasticity.

6. The article of footwear of claim 1, wherein said split plate extends into a heel region of said footwear.

7. The article of footwear of claim 1, wherein said fist portion is connected to said second portion on a longitudinal end of said split.

8. The article of footwear of claim 1, wherein said split plate includes at least one longitudinal support that extends substantially parallel to said split.

9. The article of footwear of claim 8, wherein said at least one longitudinal support includes a first longitudinal support located in said first portion and a second longitudinal support located in said second portion.

10. The article of footwear of claim 9, wherein said first and second longitudinal supports include a plurality of ribs that extend in a transverse direction relative to said first and second longitudinal supports.

11. The article of footwear of claim 9, wherein said at least one longitudinal support includes a third longitudinal support located in said first portion.

12. The article of footwear of claim 1, wherein said split plate includes a plurality of spike receptacles for receiving spikes.

13. The article of footwear of claim 1, wherein said split plate includes a plurality of traction elements for providing said footwear with traction.

14. An article of footwear having an upper for receiving a foot of a wearer and a sole structure attached to said upper, said sole structure comprising:

a split plate with a forefoot area that extends through substantially all of a forefoot portion of said footwear, said split plate having a first portion and a second portion that are formed as a one-piece element and separated by a longitudinal split formed in said split plate, said split extending from a front of the split plate to a midfoot portion of said footwear, and said split plate being formed of a first material with a first modulus of elasticity; and a separator plate that is located within said split, said separator plate being attached to said split plate and being formed of a second material with a second modulus of elasticity, said first modulus of elasticity being greater than said second modulus of elasticity.

15. The article of footwear of claim 14, wherein said separator plate includes a fore portion located forward of said split plate.

16. The article of footwear of claim 15, wherein said fore portion is formed integral with said separator plate.

17. The article of footwear of claim 14, wherein said first portion is connected to said second portion on a longitudinal end of said split.

18. The article of footwear of claim 14, wherein said first portion is located on a lateral side of said sole structure and said second portion is located on a medial side of said sole structure.

19. The article of footwear of claim 18, wherein said split is located closer to said medial side than said lateral side.

20. The article of footwear of claim 14, wherein said split plate extends into said midfoot portion of said footwear.

21. The article of footwear of claim 20, wherein said split plate extends into a heel region of said footwear.

22. The article of footwear of claim 14, wherein said split plate includes a plurality of spike receptacles for receiving spikes.

23. The article of footwear of claim 22, wherein said split plate includes a plurality of traction elements for providing said footwear with traction.

24. The article of footwear of claim 14, wherein said split plate includes at least one longitudinal support that extends substantially parallel to said split.

25. The article of footwear of claim 24, wherein said at least one longitudinal support includes a first longitudinal support located in said first portion and a second longitudinal support located in said second portion.

26. The article of footwear of claim 25, wherein said first and second longitudinal supports include a plurality of ribs that extend in a transverse direction relative to said first and second longitudinal supports.

27. The article of footwear of claim 25, wherein said at least one longitudinal support includes a third longitudinal support located in said first portion.

28. An article of footwear having an upper for receiving a foot of a wearer and a sole structure attached to said upper, said sole structure comprising:

a midsole attached to said upper and formed of a resilient foam material;

an outsole attached to a lower surface of said midsole; and a plate assembly attached to said outsole and including:

a split plate extending through substantially all of a forefoot portion of said footwear and having a lateral portion and a medial portion that are separated by a split formed in said split plate, said split plate having a forefoot area that is positioned in said forefoot portion of said footwear, said split extending entirely through said forefoot area of said split plate and in a longitudinal direction of said footwear, and said split plate being formed as a one-piece element of a first material with a first modulus of elasticity, and a separator plate that includes a longitudinal portion that is formed integral with a fore portion, said fore portion being located forward of said split plate and in the forefoot portion of said footwear, and said longitudinal portion being located within said split, said separator plate being attached to said split plate and being formed of a second material with a second modulus of elasticity, said first modulus of elasticity being greater than said second modulus of elasticity.

29. The article of footwear of claim 28, wherein said lateral portion is connected to said medial portion on a longitudinal end of said split.

30. The article of footwear of claim 28, wherein said split is located closer to a medial side of said footwear than a lateral side of said footwear.

31. The article of footwear of claim 28, wherein said spilt plate extends into said forefoot portion.

32. The article of footwear of claim 28, wherein said split plate extends into a heel region of said footwear.

33. The article of footwear of claim 28, wherein a lower surface of said split plate includes a plurality of spike receptacles for receiving spikes.

34. The article of footwear of claim 33, wherein said split plate includes a plurality of traction elements for providing said footwear with traction.

35. The article of footwear of claim 28, wherein said split plate includes at least one longitudinal support that extends substantially parallel to said split.

36. The article of footwear of claim 35, wherein said at least one longitudinal support includes a first longitudinal support located in said lateral portion and a second longitudinal support located in said medial portion.

37. The article of footwear of claim 36, wherein said first and second longitudinal supports include a plurality of ribs that extend in a transverse direction relative to said first and second longitudinal supports.

38. The article of footwear of claim 36, wherein said at least one longitudinal support includes a third longitudinal support located in said lateral portion.

39. An article of footwear having an upper and a sole structure secured to the upper, said sole structure comprising a split plate having a medial portion and a lateral portion that extend through substantially all of a forefoot portion of the footwear, the medial portion and the lateral portion being separated by a split formed in the split plate and extending longitudinally from a front of the split plate to a midfoot portion of the footwear, the medial portion and the lateral portion being unconnected in the forefoot portion of the footwear and connected in the midfoot portion of the footwear.

40. The article of footwear of claim 39, wherein the split is located closer to a medial side than a lateral side of the footwear.

41. The article of footwear of claim 39, wherein the sole structure includes a separator plate located within the split.

42. The article of footwear of claim 41, wherein the split plate is formed of a first material and the separator plate is formed of a second material, the first material having a greater modulus of elasticity than the second material.

43. The article of footwear of claim 41, wherein the separator plate includes a fore portion located forward of the front of the split plate.

44. The article of footwear of claim 39, wherein the split plate extends into a heel portion of the footwear.

45. The article of footwear of claim 39, wherein the split plate includes a plurality of spike receptacles for receiving spikes.

46. The article of footwear of claim 39, wherein the split plate includes a plurality of traction elements.

47. An article of footwear having an upper and a sole structure secured to the upper, said sole structure comprising:

a split plate formed as a one-piece element from a first material and having a medial portion and a lateral portion that extend through substantially all of a forefoot portion of the footwear, the medial portion and the lateral portion being separated by a split formed in the split plate and extending longitudinally from a front of the split plate to a midfoot portion of the footwear, the medial portion and the lateral portion being unconnected in the forefoot portion of the footwear and connected in the midfoot portion of the footwear; and a separator plate formed from a second material and located within the split, the separator plate being secured to the split plate, and the second material being different than the first material.

48. The article of footwear of claim 47, wherein the split is located closer to a medial side than a lateral side of the footwear.

49. The article of footwear of claim 47, wherein the first material has a greater modulus of elasticity than the second material.

50. The article of footwear of claim 47, wherein the split plate extends into a heel portion of the footwear.

* * * * *